US008443921B2

(12) United States Patent
Charnesky et al.

(10) Patent No.: US 8,443,921 B2
(45) Date of Patent: May 21, 2013

(54) SYSTEM AND METHOD FOR INCREASING OPERATING EFFICIENCY OF A POWERTRAIN BY CONTROLLING AN AERO SHUTTER

(75) Inventors: Scott P. Charnesky, Birmingham, MI (US); Gregory J. Fadler, Commerce Township, MI (US); Andreas Wilhelm, Seeheim-Jugenheim (DE); Reiner Weidemann, Mainz (DE); Terry C. Bishop, Chesaning, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 286 days.

(21) Appl. No.: 12/942,242

(22) Filed: Nov. 9, 2010

(65) Prior Publication Data

US 2012/0111652 A1 May 10, 2012

(51) Int. Cl.
*B60K 11/00* (2006.01)

(52) U.S. Cl.
USPC ..... 180/68.1; 701/49; 180/68.2

(58) Field of Classification Search
USPC ..... 180/68.1–68.3; 165/271; 701/49, 701/29; 454/74–75
See application file for complete search history.

(56) References Cited

U.S. PATENT DOCUMENTS

| | | | | | |
|---|---|---|---|---|---|
| 4,476,820 | A * | 10/1984 | Nixon | 123/41.05 |
| 4,756,279 | A * | 7/1988 | Temmesfeld | 123/41.04 |
| 4,779,577 | A * | 10/1988 | Ritter et al. | 123/41.05 |
| 4,924,826 | A * | 5/1990 | Vinson | 123/195 C |
| 5,669,311 | A * | 9/1997 | Hill et al. | 105/62.2 |
| 5,899,196 | A * | 5/1999 | Chite | 123/556 |
| 6,142,108 | A * | 11/2000 | Blichmann | 123/41.05 |
| 6,145,251 | A * | 11/2000 | Ricci | 49/82.1 |
| 6,227,153 | B1 * | 5/2001 | Till | 123/41.12 |
| 6,230,832 | B1 * | 5/2001 | von Mayenburg et al. | 180/68.1 |
| 6,854,544 | B2 * | 2/2005 | Vide | 180/68.6 |
| 7,128,026 | B2 * | 10/2006 | Braun et al. | 123/41.01 |
| 7,644,793 | B2 * | 1/2010 | Iwasaki et al. | 180/68.2 |
| 7,766,111 | B2 * | 8/2010 | Guilfoyle et al. | 180/68.1 |
| 7,784,576 | B2 * | 8/2010 | Guilfoyle et al. | 180/68.1 |
| 8,281,754 | B2 * | 10/2012 | Saida et al. | 123/41.04 |
| 2004/0226764 | A1 * | 11/2004 | Iwasaki et al. | 180/68.1 |
| 2006/0005790 | A1 * | 1/2006 | Braun et al. | 123/41.08 |
| 2010/0243352 | A1 * | 9/2010 | Watanabe et al. | 180/68.1 |

FOREIGN PATENT DOCUMENTS

DE 19719792 A1 11/1998

* cited by examiner

*Primary Examiner* — John Walters
*Assistant Examiner* — James Triggs
(74) *Attorney, Agent, or Firm* — Quinn Law Group, PLLC

(57) ABSTRACT

A method of increasing operating efficiency of a powertrain includes unrestricting a grille opening by fully opening a shutter at or below a first predetermined vehicle speed, and turning a fan off. The method also includes unrestricting the grille opening by fully opening the shutter above the first predetermined vehicle speed and at or below a second predetermined vehicle speed under a high powertrain cooling load, and turning the fan on. The method additionally includes partially restricting the grille opening above the second predetermined vehicle speed via an intermediate position of the shutter, and turning the fan off. A specific size of the fan together with the selected positions for the shutter at the respective vehicle speeds provides sufficient airflow through the grille opening to cool the powertrain, and provides increased powertrain operating efficiency. A system for increasing operating efficiency of a powertrain and a vehicle are also provided.

22 Claims, 4 Drawing Sheets

SYSTEM AND METHOD FOR INCREASING OPERATING EFFICIENCY OF A POWERTRAIN BY CONTROLLING AN AERO SHUTTER

TECHNICAL FIELD

The invention relates to a system and a method for improving operating efficiency of a powertrain by controlling an aero shutter.

BACKGROUND

A shutter is typically a solid and stable covering for an opening. A shutter frequently consists of a frame and louvers or slats mounted within the frame.

Louvers may be fixed, i.e., having a permanently set angle with respect to the frame. Louvers may also be operable, i.e., having an angle that is adjustable with respect to the frame for permitting a desired amount of light, air, and/or liquid to pass from one side of the shutter to the other. Depending on the application and the construction of the frame, shutters can be mounted to fit within, or to overlap the opening. In addition to various functional purposes, particularly in architecture, shutters may also be employed for largely ornamental reasons.

In motor vehicles, a shutter may be employed to control and direct a stream of light and/or air to various vehicle compartments. Therefore, a shutter may be employed to enhance comfort of vehicle passengers, as well as for cooling a range of vehicle systems.

SUMMARY

A method is disclosed for increasing operating efficiency of a powertrain in a vehicle by controlling airflow for cooling the powertrain. The vehicle includes a grille opening and a fan characterized by a predetermined size and capable of being selectively turned on and off. The method includes unrestricting the grille opening by selecting a fully opened position for an adjustable shutter arranged relative to the grille opening at or below a first predetermined vehicle speed, and turning the fan off. The method also includes unrestricting the grille opening by selecting the fully opened position for the shutter above the first predetermined vehicle speed and at or below a second predetermined vehicle speed under a high powertrain cooling load, and turning the fan on. The method additionally includes partially restricting the grille opening by selecting an intermediate position for the shutter above the second predetermined vehicle speed, and turning the fan off. The predetermined size of the fan together with selecting one of the fully opened and intermediate positions of the shutter at the respective predetermined vehicle speeds provides sufficient airflow through the grille opening to cool the powertrain.

When the employed fan is characterized by a size that is predetermined to be the minimum capable for sufficiently cooling the powertrain, such a fan serves to increase the operating efficiency of the powertrain due to decreased parasitic drag on the engine. Furthermore, controlling the shutter to decrease the size of the grille opening above the second predetermined vehicle speed limits the amount of high-speed ram airflow and improves aerodynamic efficiency of the vehicle. Such an improvement in the aerodynamic efficiency further serves to increase the operating efficiency of the powertrain.

The method may also include monitoring the ambient temperature and selecting and locking a predetermined position for the shutter at any vehicle speed when the ambient temperature is below a predetermined value, such as near and below freezing.

According to the method, the shutter may additionally employ a mechanism configured to select and lock a position for the shutter between and inclusive of the fully opened and fully closed. The shutter may be arranged either integral with or adjacent to the grille opening.

The above-mentioned acts of selecting the shutter positions between and inclusive of the fully opened and the fully closed via the mechanism, and turning the fan on and off may be accomplished by a controller. The powertrain may include an internal combustion engine, and the act of regulating of the shutter by the controller may be accomplished according to a load on the engine. The vehicle may include a heat exchanger, and the engine may be cooled by a fluid that is circulated through the heat exchanger such that the engine is cooled by the fluid. The vehicle may additionally include a sensor that is configured to sense a temperature of the fluid. Furthermore, the shutter may be regulated by the controller according to the sensed temperature of the fluid.

A system for increasing an operating efficiency of a powertrain and a vehicle that employs the above-described method for increasing an operating efficiency of an engine are also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
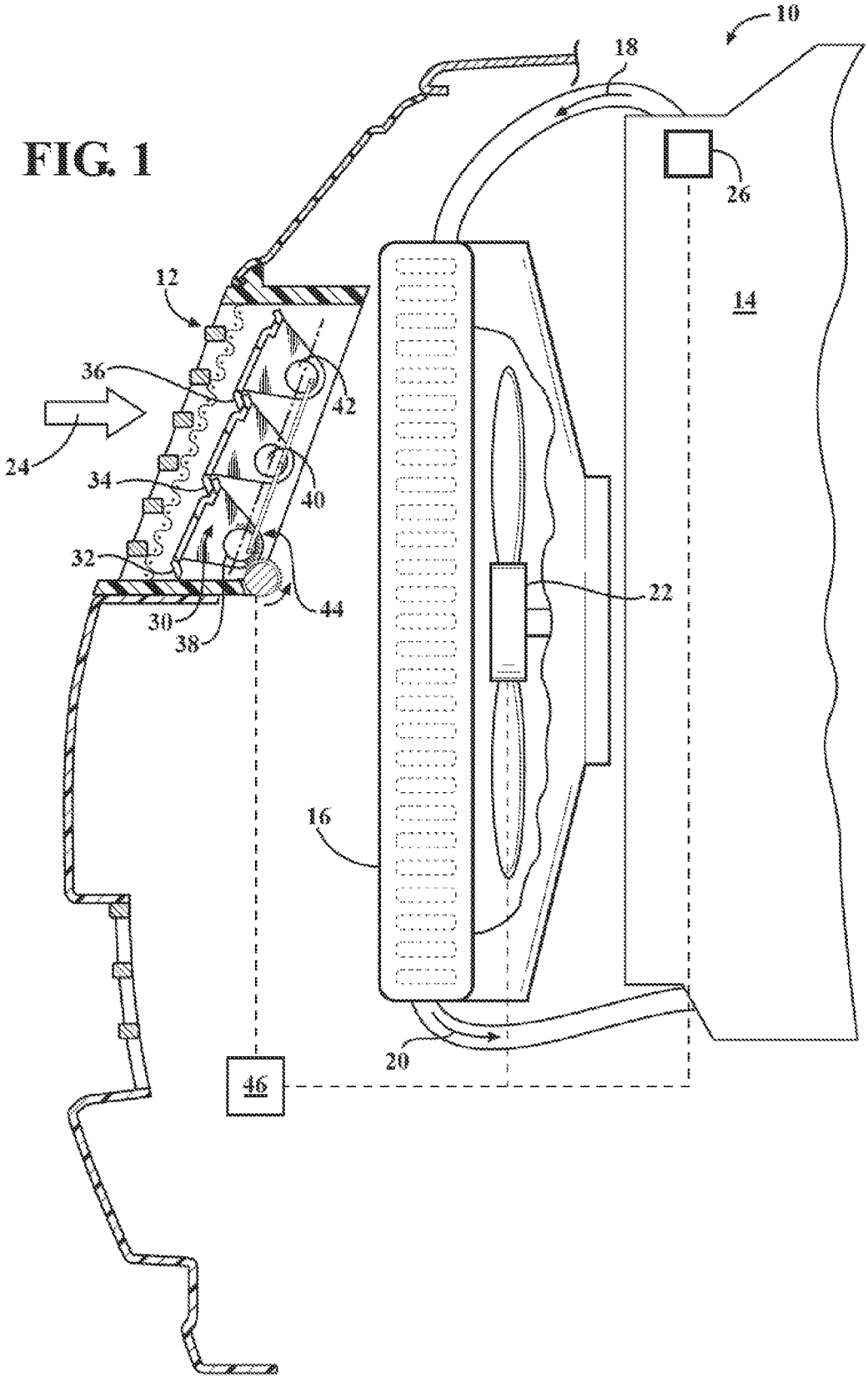
FIG. 1 is a partial side view of a vehicle having a shutter depicted in a fully closed state.
Figure 2:
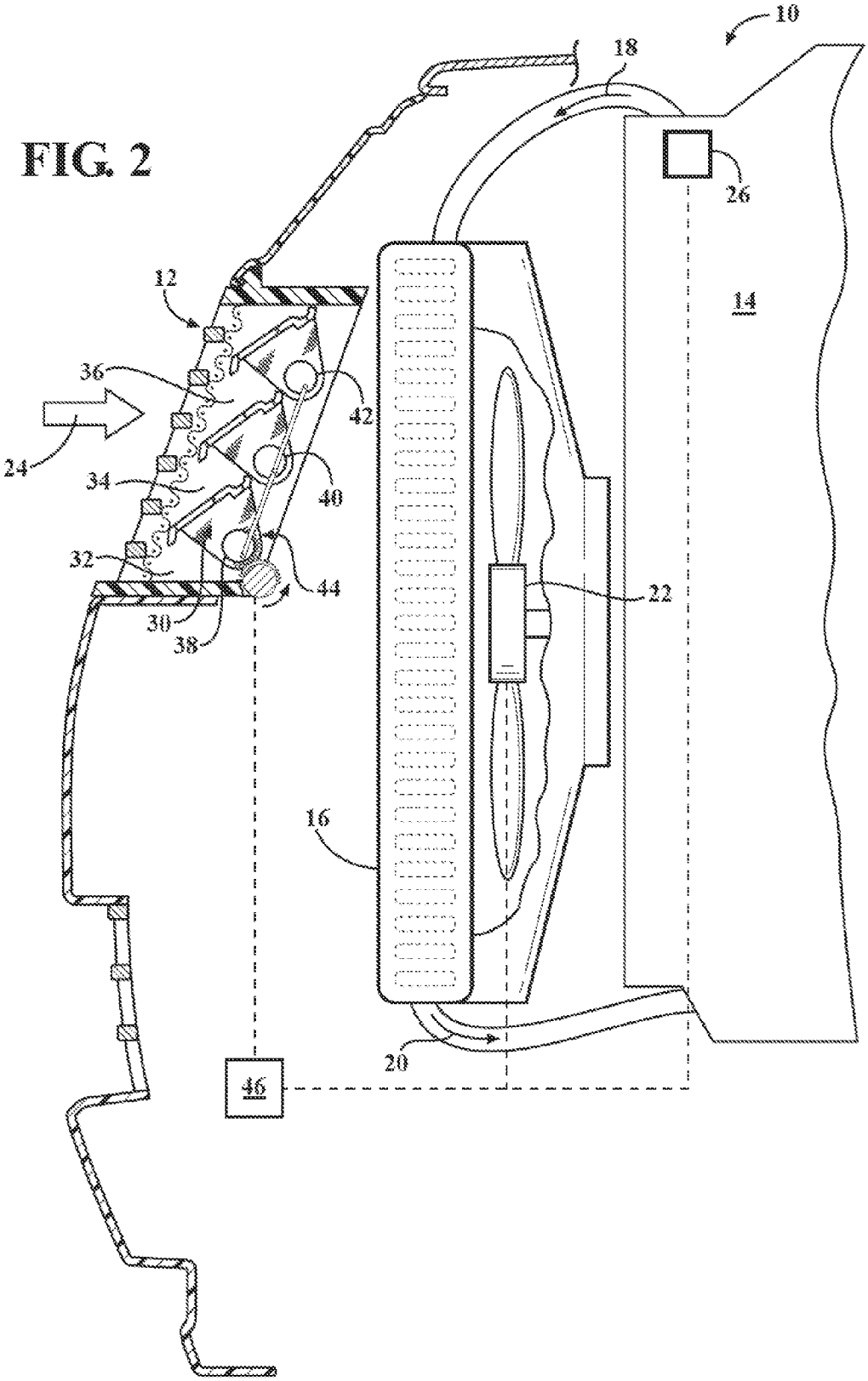
FIG. 2 is a partial side view of a vehicle having the shutter shown in FIG. 1, with the shutter depicted in an intermediate state.
Figure 3:
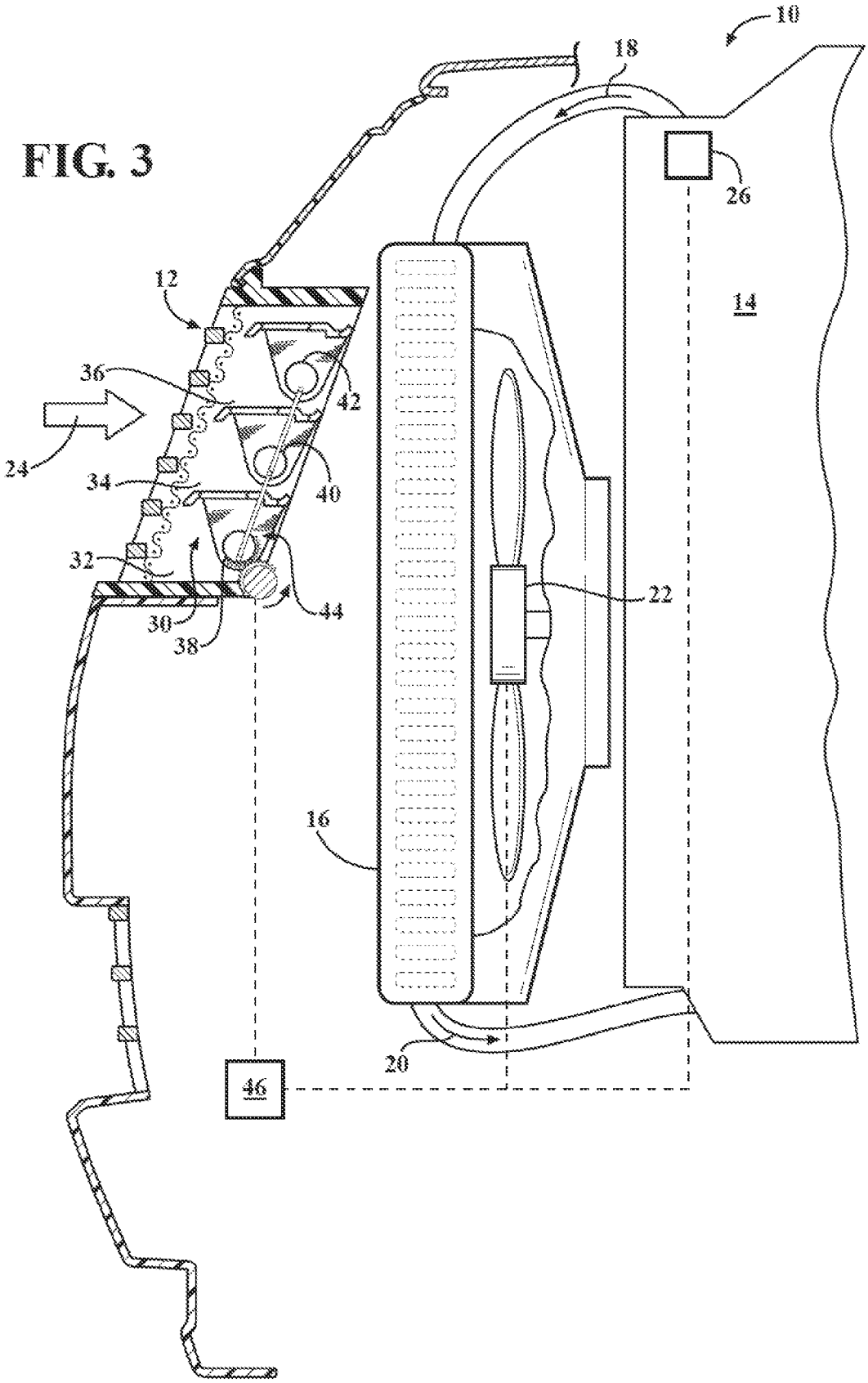
FIG. 3 is a partial side view of a vehicle having the shutter system shown in FIGS. 1 and 2, with the shutter depicted in a fully opened state.

Referring to the drawings, wherein like reference numbers refer to like components, FIGS. 1-3 show a partial side view of a vehicle 10. Vehicle 10 is shown to include a grille opening 12 typically covered with a mesh. Grille opening 12 is adapted for receiving ambient air. Vehicle 10 additionally includes a powertrain that is specifically represented by an internal combustion engine 14. The powertrain of vehicle 10 may additionally include a transmission, and, if the vehicle is a hybrid type, one or more motor-generators, none of which is shown, but the existence of which can be appreciated by those skilled in the art. Efficiency of a vehicle powertrain is generally influenced by its design, as well as by the various loads the powertrain sees during its operation.

Vehicle 10 additionally includes an air-to-fluid heat exchanger 16, i.e., a radiator, for circulating a cooling fluid shown by arrows 18 and 20, such as water or a specially formulated coolant, though the engine 14 to remove heat from the engine. A high-temperature coolant entering the heat exchanger 16 is represented by the arrow 18, and a reduced-temperature coolant being returned to the engine is represented by an arrow 20. Heat exchanger 16 is positioned behind the grille opening 12 for protection of the heat exchanger from various road-, and air-borne debris. The heat exchanger 16 may also be positioned in any other location, such as behind a passenger compartment, if, for example, the vehicle has a rear or a mid-engine configuration, as understood by those skilled in the art.

As shown in FIGS. 1-3, a fan 22 is positioned in the vehicle 10, behind the heat exchanger 16, such that the heat exchanger 16 is positioned between the grill opening 12 and the fan. Fan 22 is capable of being selectively turned on and off based on the cooling needs of engine 14. Depending on the road speed of the vehicle 10, fan 22 is adapted to either generate or enhance a stream of air or airflow 24 through the grille opening 12, and toward and through the heat exchanger 16. Thus generated or enhanced through the action of fan 22, airflow 24 is passed through heat exchanger 16 to remove heat from the high-temperature coolant 18 before the reduced-temperature coolant 20 is returned to engine 14. Fan 22 may be driven either electrically, or mechanically, directly by engine 14. Vehicle 10 additionally includes a coolant sensor 26 configured to sense a temperature of the high-temperature coolant 18 as it exits engine 14.

Because fan 22 is driven by engine 14, size of the fan is typically selected based on the smallest fan that in combination with the available grille opening 12 is sufficient to cool the engine during severe or high load conditions imposed on vehicle 10. Typically, however, when the size of grille opening 12 is tailored to such severe load conditions, the grille opening generates significant aerodynamic drag on the vehicle which causes a loss in operating efficiency of engine 14. On the other hand, if the size of the grille opening 12 is chosen based on the aerodynamic and operating efficiency requirements at higher vehicle speeds, the size of fan 22 that is required to generate sufficient airflow at high load conditions becomes so great, that the fan generates significant parasitic drag on engine 14. Therefore, an adjustable or variable size for the grille opening 12 would permit fan 22 to be sized for minimum parasitic drag on the engine 14, while being capable of satisfying the high vehicle load cooling requirements. At the same time, such an adjustable grille opening 12 would permit selection of a smaller fan that would further serve to increase the operating efficiency of the powertrain.

FIGS. 1-3 also depict a rotatable or adjustable shutter 30. Shutter 30 is secured in vehicle 10 and is adapted to control airflow 24 through the grille opening 12. As shown, shutter 30 is positioned behind, and immediately adjacent to grille opening 12 at the front of the vehicle 10. As shown, shutter 30 is positioned between the grille opening 12 and the heat exchanger 16. Shutter 30 may also be incorporated into and be integral with the grille opening 12. Shutter 30 includes a plurality of louvers, herein shown as having three individual louver elements 32, 34, and 36, but the number of louvers may either be fewer or greater. Each louver 32, 34, and 36 is configured to rotate about a respective pivot axis 38, 40, and 42 during operation of the shutter 30, thereby effectively controlling the size of the grille opening 12. Shutter 30 is adapted to operate between and inclusive of a fully closed position or state (as shown in FIG. 1), through an intermediate position (as shown in FIG. 2), and to a fully opened position (as shown in FIG. 3). When louver elements 32, 34, and 36 are in any of their open positions, airflow 24 penetrates the plane of shutter 30 before coming into contact with the heat exchanger 16.

Shutter 30 also includes a mechanism 44 configured to select and lock a desired position for the shutter between and inclusive of fully opened and fully closed. Mechanism 44 is configured to cause louvers 32-36 to rotate in tandem, i.e., substantially in unison, and permitting the shutter 30 to rotate into any of the available positions. Mechanism 44 may be adapted to select and lock either discrete intermediate position(s) of the louvers 32-36, or to infinitely vary position of the louvers between and inclusive of the fully opened and fully closed. Mechanism 44 acts to select the desired position for the shutter 30 when activated by any external means, as understood by those skilled in the art, such as an electric motor (not shown). Vehicle 10 also includes a controller 46, which may be an engine controller or a separate control unit, configured to regulate mechanism 44 for selecting the desired position of the shutter 30. Controller 46 may also be configured to operate the fan 22, if the fan is electrically driven, and a thermostat (not shown) that is configured to regulate the circulation of coolant, as understood by those skilled in the art.

Controller 46 is programmed to regulate mechanism 44 according to the load on engine 14 and, correspondingly, to the temperature of the coolant sensed by sensor 26. The temperature of the high-temperature coolant 18 is increased due to the heat produced by engine 14 under load. As known by those skilled in the art, a load on the engine is typically dependent on operating conditions imposed on the vehicle 10, such as going up a hill and/or pulling a trailer. The load on engine 14 generally drives up internal temperature of the engine, which in turn necessitates cooling of the engine for desired performance and reliability. Prior to exiting the engine 14, coolant is routed inside the engine in order to most effectively remove heat from critical engine components, such as bearings (not shown, but known by those skilled in the art). Typically, the coolant is continuously circulated by a fluid pump (not shown) between engine 14 and heat exchanger 16.

When the shutter 30 is fully closed, as depicted in FIG. 1, louvers 32-36 provide blockage of the airflow 24 at the grille opening 12. A fully closed shutter 30 provides optimized aerodynamics for vehicle 10 when engine cooling through the grille opening 12 is not required. The shutter 30 may also be regulated by controller 46 to variably restrict access of the oncoming airflow 24 to heat exchanger 16, by rotating louvers 32-36 to an intermediate position, as shown in FIG. 2, where the louvers are partially closed. An appropriate intermediate position of louvers 32-36 is selected by the controller 46 according to a programmed algorithm to thereby affect the desired cooling of engine 14. When the shutter 30 is fully opened, as shown in FIG. 3, each louver 32-36 is rotated to a position parallel to the airflow 24 seeking to penetrate the shutter system plane. Thus, a fully opened shutter 30 is configured to permit a generally unfettered passage of such a stream of air through the louver plane of shutter 30.

In a moving vehicle 10, airflow 24 at ambient temperature and traveling at a certain velocity with respect to the vehicle penetrates the vehicle's grille opening 12. Airflow 24 that moves relative to the vehicle 10 traveling at elevated vehicle speeds generates positive air pressure at grille opening 12, and is thus termed "RAM airflow". In a vehicle 10 traveling at or below a first predetermined speed, including when the vehicle is stationary, airflow 24 at ambient temperature and traveling at a certain low velocity with respect to the vehicle penetrates the vehicle's grille opening 12. Airflow 24 that moves relative to the vehicle 10 traveling at or below the first predetermined speed generates a minimal positive pressure at grille opening 12. Nonetheless, air flow 24 at such low pressures is sufficient to cool the engine 14 at lower vehicle speeds and loads. The first predetermined vehicle speed is typically established during testing and development of vehicle 10. Thus, when shutter 30 is fully opened at or below the first predetermined speed, fan 22 may be turned off in order to reduce the parasitic load on engine 14 and improve the operating efficiency of the powertrain.

Although in a moving vehicle 10 airflow 24 generates some positive pressure at the grill opening 12, at certain vehicle speeds coupled with increased vehicle loads the velocity of airflow 24 may be insufficient to generate sufficient RAM airflow to cool engine 14. Such may be the case even when the shutter 30 is fully opened and the grille opening 12 is unrestricted. Vehicle loads increase significantly, for example, in situations when vehicle 10 is required to pull a trailer up a grade, especially during warmer, summer temperatures. In a vehicle 10 traveling above the first predetermined vehicle speed and at or below a second predetermined vehicle speed, airflow 24 at ambient temperature and traveling at a certain velocity with respect to the vehicle generates some measure of RAM airflow at grille opening 12.

The second predetermined vehicle speed is a speed above which the resultant volume of airflow 24 traveling through a partially restricted grille opening 12 is sufficient to remove heat from coolant 18 entering the heat exchanger 16 without turning on fan 22. Such second predetermined vehicle speed is typically established during testing and development of vehicle 10. As noted above, the RAM airflow generated between the first predetermined and the second predetermined vehicle speeds may, however, be insufficient to cool engine 14. With vehicle 10 operating under a high powertrain load below the second predetermined vehicle speed, grille opening 12 may need to be completely unrestricted and the fan 22 turned on to impart maximum airflow 24 to heat exchanger 16. Hence, depending on the speed and loading conditions of vehicle 10, fully opening the shutter 30 and turning the fan 22 on may be necessary to generate sufficient airflow 24 to lower the coolant temperature inside heat exchanger 16, and thereby cool engine 14.

In a vehicle 10 traveling above the second predetermined vehicle speed, airflow 24 at ambient temperature and traveling at a certain velocity with respect to the vehicle generates a significant RAM airflow at grille opening 12. As described above, the second predetermined vehicle speed is a speed above which the resultant volume of airflow 24 traveling through a partially restricted grille opening 12 is sufficient to remove heat from coolant 18 entering the heat exchanger 16 without turning on fan 22. Therefore, above the second predetermined vehicle speed, some particular intermediate position of shutter 30 may be selected, while fan 22 is turned off, thus permitting sufficient amount of airflow 24 to reach the heat exchanger 16 to thereby cool engine 14. Appropriate intermediate positions of shutter 30 corresponding to particular speed and load conditions may be established during testing and development of vehicle 10. Thus, controlling shutter 30 to decrease the size of grille opening 12 above the second predetermined vehicle speed limits the amount of high-speed RAM airflow and improves aerodynamic efficiency of vehicle 10 and the operating efficiency of its powertrain.

Ambient temperatures near and below freezing may present additional considerations for cooling of the powertrain in the vehicle 10. When the ambient temperature is below a predetermined value, i.e., near or below freezing, sufficient cooling of engine 14 may be achieved with the grille opening 12 either in a partially restricted or in a fully blocked state. At the same time, louvers 32-36 and mechanism 44 may freeze and become jammed at such low temperatures. Therefore, in order to prevent jamming of the shutter 30 in some unwanted position, when the ambient temperature is below the predetermined value, an appropriate predetermined position of shutter 30 may be selected and locked without regard to vehicle speed and load. The grille opening 12 may be placed in any position between and inclusive of the fully open and the fully restricted states via the predetermined position of the shutter 30 depending on the cooling requirements of the powertrain of vehicle 10.

The predetermined locked position or a number of discrete locked positions of the shutter 30 that would still permit sufficient cooling of the powertrain near and below freezing ambient temperatures may be established empirically during testing and development of the vehicle 10. The controller 46 may be employed to monitor the ambient temperature via a temperature sensor (not shown) and regulate and lock the position of the shutter 30 via the mechanism 44 in response to the ambient temperature being below the predetermined value. Depending on the vehicle load, the fan 22 may be either turned on or off via the controller 46 while the shutter 30 remains in the predetermined locked position. Full control over the selectable positions of shutter 30 may then be returned when the ambient temperature again rises above the predetermined value.

Figure 4:
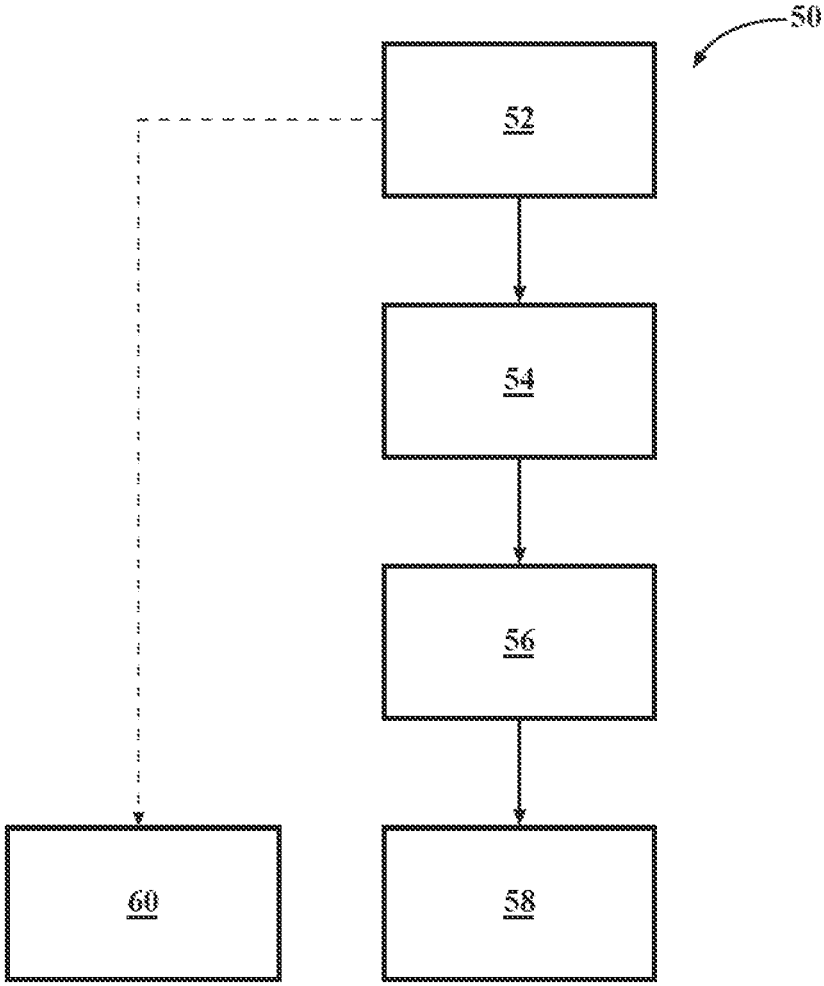
FIG. 4 is a flow chart illustrating a method for controlling a flow of air through a grille opening in the vehicle depicted in FIGS. 1-3.

FIG. 4 depicts a method 50 for increasing an operating efficiency of a powertrain by controlling the airflow 24 through grille opening 12 in vehicle 10 via shutter system 30, as described above with respect to FIGS. 1-3. The method commences in frame 52 and then proceeds to frame 54 where it includes unrestricting grille opening 12 by selecting the fully opened position for shutter 30 via controller 46 at or below the first predetermined vehicle speed. Additionally, in frame 52 the method includes turning the fan 22 off via controller 46, with the result being that sufficient airflow is provided through the unrestricted grille opening 12 to cool the powertrain. Following frame 54, the method advances to frame 56.

In frame 56, the method includes unrestricting the grille opening 12 by selecting the fully opened position for shutter 12 via controller 46, when vehicle 10 is subjected to a high powertrain cooling load and is traveling above the first predetermined speed and at or below the second predetermined speed. Additionally, in frame 56 the method includes, turning the fan 22 on via controller 46, with the result being that sufficient airflow is provided through the unrestricted grille opening 12 to cool the powertrain. Following frame 56, the method proceeds to frame 58, where it includes partially restricting the grille opening 12 by selecting the intermediate position for shutter 30 via controller 46 above the second predetermined vehicle speed. Additionally, in frame 58 the method includes turning the fan 22 off via controller 46, with the result being that sufficient airflow is provided through the partially restricted grille opening 12 to cool the powertrain.

Additionally, at or near freezing ambient temperatures, the method may proceed directly from frame 52 to frame 60. In frame 60, regardless of vehicle speed, the controller 46 regulates mechanism 44 to position and lock the shutter 30 in a predetermined position which may include a fully closed state. Overall, the regulation of fan 22 sized to generate sufficient airflow at high vehicle loading conditions, together with employing adjustable shutter 30 to tailor the size of grille opening 12 to the cooling requirements of engine 14, permits heretofore contradictory vehicle requirements to be met. Furthermore, the above described combination of fan 22 and shutter 30 results in increased operating efficiency of the powertrain in vehicle 10.

While the best modes for carrying out the invention have been described in detail, those familiar with the art to which this invention relates will recognize various alternative designs and embodiments for practicing the invention within the scope of the appended claims.

The invention claimed is:

1. A method for increasing an operating efficiency of a powertrain in a vehicle having a grille opening, and a fan characterized by a predetermined size and capable of being selectively turned on and off, the method comprising:

unrestricting the grille opening by selecting a fully opened position for an adjustable shutter arranged relative to the grille opening at or below a first predetermined vehicle speed, and turning the fan off, such that sufficient airflow is provided through the unrestricted grille opening to cool the powertrain;

unrestricting the grille opening by selecting the fully opened position for the shutter above the first predetermined vehicle speed and at or below a second predetermined vehicle speed under a high powertrain cooling load, and turning the fan on, such that sufficient airflow is provided through the unrestricted grille opening to cool the powertrain; and partially restricting the grille opening by selecting an intermediate position for the shutter above the second predetermined vehicle speed, and turning the fan off, such that sufficient airflow is provided through the partially restricted grille opening to cool the powertrain;

wherein the predetermined size of the fan together with said selecting one of the fully opened and intermediate positions of the shutter at the respective predetermined vehicle speeds increase the operating efficiency of the powertrain.

2. The method of claim 1, further comprising monitoring the ambient temperature and selecting and locking a predetermined position for the shutter in response to the ambient temperature being below a predetermined value.

3. The method of claim 2, the shutter including a mechanism configured to select and lock a position for the shutter between and inclusive of the fully opened and the fully closed positions, the method further comprising selecting the shutter position between and inclusive of the fully opened and the fully closed.

4. The method of claim 3, the vehicle including a controller adapted for selectively turning the fan on and off and for selecting the shutter positions between and inclusive of the fully opened and the fully closed via the mechanism, the method further comprising selectively turning the fan on and off and selecting the shutter position between and inclusive of the fully opened and the fully closed by the controller.

5. The method of claim 4, wherein the powertrain includes an internal combustion engine, and said selectively turning the fan on and off and said selecting the shutter positions between and inclusive of the fully opened and the fully closed is accomplished by the controller according to a load on the engine.

6. The method of claim 5, wherein the vehicle includes a heat exchanger and a fluid circulated through the heat exchanger such that the engine is cooled by the fluid, and a sensor configured to sense a temperature of the fluid, the method further comprising cooling the engine by the fluid and sensing the temperature of the fluid by the sensor.

7. The method of claim 6, further comprising selectively turning the fan on and off and selecting the shutter position between and inclusive of the fully opened and the fully closed by the controller according to the sensed temperature of the fluid.

8. The method of claim 1, wherein the shutter is arranged one of integral to the grille opening and adjacent to the grille opening.

9. A system for increasing an operating efficiency of a powertrain in a vehicle, the system comprising:

a grille opening adapted for receiving an airflow;

a fan characterized by a predetermined size, capable of being selectively turned on and off, and adapted to draw the airflow through the grille opening;

an adjustable shutter arranged relative to the grille opening; and a controller adapted to:

unrestrict the grille opening by selecting a fully opened position for the shutter at or below a first predetermined vehicle speed, and turn the fan off, such that sufficient airflow is provided through the unrestricted grille opening to cool the powertrain;

unrestrict the grille opening by selecting the fully opened position for the shutter above the first predetermined vehicle speed and at or below a second predetermined vehicle speed under a high powertrain cooling load, and turn the fan on, such that sufficient airflow is provided through the unrestricted grille opening to cool the powertrain; and partially restrict the grille opening by selecting an intermediate position for the shutter above the second predetermined vehicle speed, and turn the fan off, such that sufficient airflow is provided through the partially restricted grille opening to cool the powertrain;

wherein the predetermined size of the fan together with the controller selecting one of the fully opened and intermediate positions of the shutter at the respective predetermined vehicle speeds increases the operating efficiency of the powertrain.

10. The system of claim 9, wherein the controller is further adapted to monitor the ambient temperature and to select and lock a predetermined position for the shutter in response to the ambient temperature being below a predetermined value.

11. The system of claim 9, wherein the shutter includes a mechanism configured to be regulated by the controller to select and lock a position for the shutter between and inclusive of the fully opened and fully closed.

12. The system of claim 9, wherein the powertrain includes an internal combustion engine, wherein the controller selectively turns the fan on and off and selects the shutter positions between and inclusive of the fully opened and the fully closed according to a load on the engine.

13. The system of claim 12, wherein the vehicle includes a heat exchanger positioned between the grill opening and the fan for circulating the fluid through the heat exchanger such that the engine is cooled by the fluid, and a sensor configured to sense a temperature of the fluid, and wherein the controller is further adapted to select the shutter positions according to the sensed temperature of the fluid.

14. The system of claim 9, wherein the shutter is arranged one of integral to the grille opening and adjacent to the grille opening.

15. A vehicle comprising:

an internal combustion engine cooled by a fluid;

a grille opening adapted for receiving an airflow;

a fan characterized by a predetermined size, capable of being selectively turned on and off, and adapted to draw the airflow through the grille opening;

a heat exchanger positioned between the grill opening and the fan for circulating the fluid though the engine;

an adjustable shutter arranged relative to the grille opening; and a controller adapted to:

unrestrict the grille opening by selecting a fully opened position for the shutter at or below a first predetermined vehicle speed, and turn the fan off, such that sufficient airflow is provided through the unrestricted grille opening to cool the engine;

unrestrict the grille opening by selecting the fully opened position for the shutter above the first predetermined vehicle speed and at or below a second predetermined vehicle speed under a high engine cooling load, and turn the fan on, such that sufficient airflow is provided through the unrestricted grille opening to cool the engine; and partially restrict the grille opening by selecting an intermediate position for the shutter above the second predetermined vehicle speed, and turn the fan off, such that sufficient airflow is provided through the partially restricted grille opening to cool the engine;

wherein the predetermined size of the fan together with the controller selecting one of the fully opened and intermediate positions of the shutter at the respective predetermined vehicle speeds increases the operating efficiency of the engine.

16. The vehicle of claim 15, wherein the controller is adapted to fully restrict the grille opening by selecting the fully closed position for the shutter when the ambient temperature is below a predetermined value.

17. The vehicle of claim 15, wherein the shutter includes a mechanism configured to be regulated by the controller to select a position for the shutter between and inclusive of the fully opened and fully closed.

18. The vehicle of claim 15, wherein the controller is adapted to selectively turn the fan on and off and select the shutter positions between and inclusive of the fully opened and the fully closed according to a load on the engine.

19. The vehicle of claim 18, further comprising a sensor configured to sense a temperature of the fluid, and wherein the controller is further adapted to select the shutter positions according to the sensed temperature of the fluid.

20. The vehicle of claim 15, wherein the shutter is arranged one of integral to the grille opening and adjacent to the grille opening.

21. A method for increasing an operating efficiency of a powertrain in a vehicle having a grille opening, and a fan characterized by a predetermined size and capable of being selectively turned on and off, the method comprising:

monitoring the ambient temperature; and selecting and locking a predetermined position for an adjustable shutter arranged relative to the grille opening in response to the ambient temperature being below a predetermined value and regulating operation of the fan, such that sufficient airflow is provided to cool the powertrain at the predetermined position of the shutter and the ambient temperature.

22. The method of claim 21, the vehicle including a mechanism configured to select and lock a position for the shutter between and inclusive of a fully opened and the fully closed positions, and a controller adapted for selectively turning the fan on and off and for selecting the shutter positions via the mechanism, the method further comprising turning the fan off, wherein said monitoring the ambient temperature, said selecting the predetermined position for the shutter, and said turning the fan off are each accomplished by the controller.

* * * * *